United States Patent [19]

Miller

[11] Patent Number: 4,895,541

[45] Date of Patent: Jan. 23, 1990

[54] FLYING MODEL AIRPLANE

[76] Inventor: William H. Miller, 636 S. River Dr., Tempe, Ariz. 85281

[21] Appl. No.: 303,555

[22] PCT Filed: Nov. 25, 1987

[86] PCT No.: PCT/US87/03137

§ 371 Date: Aug. 1, 1988

§ 102(e) Date: Aug. 1, 1988

[87] PCT Pub. No.: WO89/04707

PCT Pub. Date: Jun. 1, 1989

[51] Int. Cl.[4] ..... A63H 27/18; A63H 27/22; A63H 27/24

[52] U.S. Cl. ..... 446/57; 446/60; 446/93

[58] Field of Search ..... 446/61, 66, 57, 59, 446/60, 88, 93–95, 34

[56] References Cited

U.S. PATENT DOCUMENTS

| | | | |
|---|---|---|---|
| 2,042,715 | 6/1936 | Hunt | 446/60 |
| 2,637,139 | 5/1953 | Harris | 446/30 |
| 3,827,181 | 8/1974 | Mabuchi | 446/57 |

FOREIGN PATENT DOCUMENTS

| | | | |
|---|---|---|---|
| 639546 | 6/1950 | United Kingdom | 446/60 |

*Primary Examiner*—Mickey Yu

*Attorney, Agent, or Firm*—Albert O. Cota

[57] ABSTRACT

A flying model airplane which has a triangular shaped fuselage (20) with a wing (34) attached through a combination of an attaching eye (28) passing through a wing interlocking member (38) held in place by a landing gear wire strut (54). A tail is similarly attached with a body dovetail fastener (32) penetrating a tail attaching plate (46) through which a stabilizer projecting finger (50) is positioned. The wing is further supported by a pair of tendons (40) attached to the fuselage through a hook (26) on one end and a wing supporting hook (36) on the other. The model is assembled or dissembled repeatively heretofore unavailable.

6 Claims, 1 Drawing Sheet

FLYING MODEL AIRPLANE

TECHNICAL FIELD

The present invention relates to models in general, and more specifically to flying model airplanes with attachments allowing positive assembly and dissembly of component parts.

BACKGROUND ART

Model airplanes have been known and in common use almost since the time that engine driven aircraft became a reality. Flying models have been popular and have, in the past, been fabricated of a balsa wood structure covered with fabric or thermoplastic material, hollow, or solid expanded plastic, such as urethane foam and blown polystyrene beads, also, flat wood, or plastic sheet, etc., each representing either a specific aircraft or a derivation thereof. Flying model airplanes have also been powered by twisted rubber bands, gasoline, or electric motors, compressed gas, or rocket type thrusters in many styles and configurations, each attempting to simulate flight using the basic aerodynamic principles of an original craft. Prior art has been attempting to achieve a number of different goals, that of scales miniaturization and optimum flying qualities, regardless of appearance. The instant invention is directed to an approach that is inexpensive enough to be practical and, yet, have sufficient structural integrity to function efficiently with enough shape to allow detail to be illustrated projecting the feel and general appearance of the original aircraft. Further, the invention allows easily removable structural joining of component parts heretofore unavailable in the combination thus disclosed.

DISCLOSURE OF THE INVENTION

Since model airplanes powered by rubber bands or direct current electric motors must, by their very nature, be extremely light and fragile, the problem of assembly and dissembly has plagued model builders. It is, therefore, the primary object of the invention to provide a model that is fabricated of a thin foam thermoset material with junctions to the major components so interrelated that only two connections need to be made to assemble or dissemble all of the major elements. This is accomplished by mating the wing to the fuselage and inserting the landing gear into an eye that is directed through a reinforced interlocking member in the wing tieing all three members securely together. The tail is similarly joined with the elevator juxtapositioned on the top of the fuselage and the vertical stabilizer having a projecting finger interface with an inverted dovetail on the body. Again, three elements are connected together using an integral reinforced joint.

An important object of the invention uses a triangular fuselage with two sides bonded together and a separate bottom inserted between the sides creating a strong body that not only has integrity of stiffness, but also gives depth to the thin material. Further, the triangular shape is slightly below the top outline of the fuselage allowing the cockpit area to extend above, giving further appearance of width relationship simulating the actual aircraft structure.

Another object of this triangular shape lends the model to have the details printed or silk screened on the outside surface of each side. These details outline features of the aircraft, such as cockpit structure, engine exhaust, access doors, rivet lines, engine cowl, and the like. The printing is easily accomplished in the flat prior to assembly making the procedure easy and fast to accomplish.

Still another object of the invention allows the flat material to be bent in an aerodynamic shape forming the wing to give lift to the surface. This shape is maintained by the matching cutout in the fuselage and is easily preserved as the attachment is made in this area and the rear portion is interlocked into a cutout.

Yet another object of the invention allows the model to be propelled by either twisted rubber bands, or an electric motor, with equal ease, and since the fuselage is hollow, the elements are located within covering the apparatus completely. This arrangement does not distract from the physical appearance of the airplane, as the outside is not unencumbered with the propulsion means that would be dissimilar to the engine in the original aircraft.

A final object of the invention provides means to fabricate the model using die cut parts, silk screen, or printed outside surface, and injection molded thermoplastic accessories and findings. These fabrication procedures lend themself to high production, cost effective manufacturing techniques that allow the model to be competitively priced and have a pleasant accurate physical appearance attractive to the young and old alike.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
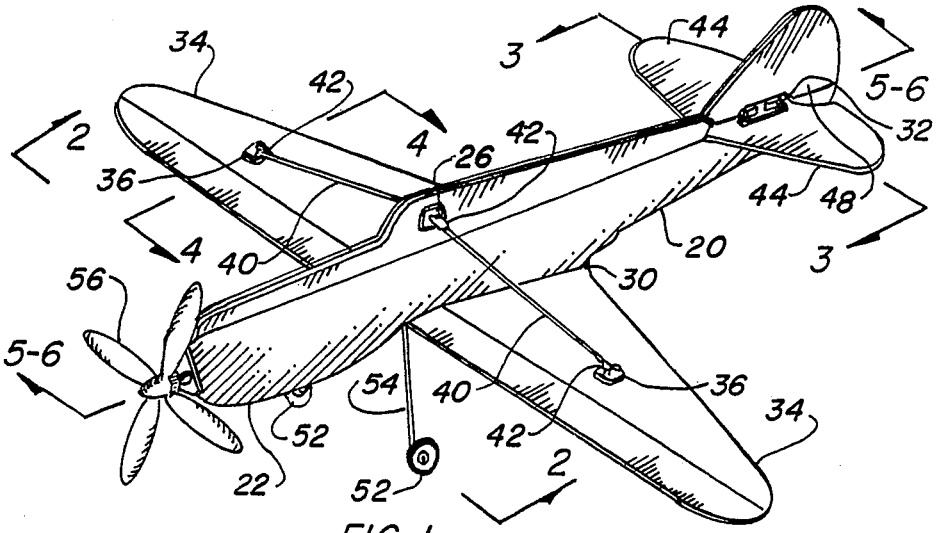
FIG. 1 is a partial isometric view of the preferred embodiment in its assembled mode.
Figure 2:
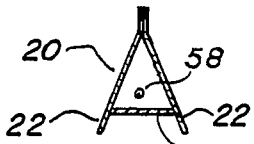
FIG. 2 is a cross-sectional view taken along lines 2—2 of FIG. 1 illustrating a cross-section of the fuselage.

The best mode for carrying out the invention is presented in terms of a preferred and a second embodiment. Both embodiments are primarily designed using the same basic structure, except for the propeller rotating means which may be either rubber band or electric motor.

The preferred embodiment, as shown in FIGS. 1 through 5 is comprised of a fuselage 20 having the basic shape of the original aircraft formed with two sides and a bottom. The sides 22 of the fuselage 20 are identical in shape with markings on opposite surfaces and are bonded together with adhesive, or the like, at the top and are formed into an isosceles triangle having the unequal angle at the top and equal angles at the bottom. The triangle shape starts somewhat below the extreme upper surface at a point in a straight line continuing from front to back of the model. This arrangement allows the cockpit area, or other projecting surfaces, to be joined flat with the triangle starting in a full portion of the body. The triangular shape has a height to width ratio of from 1.12 : 1.0 to 1.50 : 1.0 tapering such that the model simulates the contour of the original airplane. The bottom 24 is a separate piece that is glued to the sides, and is basically flat, tapering from the front to the rear gradually or even widening at the wing area according to the shape of the aircraft from which the model is duplicated.

The fuselage 20 further contains a projecting tendon hook 26 on each side near the top above the area where the wing is located. This hook is two-sided and grips the outside surface of the fuselage 20 on either side with hooks projecting in opposite directions.

The bottom 24 of the fuselage 20 contains a wing attaching eye 28 at the portion of the body where the forward segment of the wing interfaces and the rearward area contains a recess 30 which encompasses a wing trailing edge.

The fuselage 20 further contains an inverted dovetail fastener 32 at the upper trailing end for attachment of the tail. All of the above fasteners 26, 28 and 32 are fabricated using an injection molded thermoplastic material. Each fastener consist of a two-part assembly that provides an extended surface on each side of the body or fuselage with connecting penetration therethrough providing a permanent secure anchoring joint over a relatively large surface area of the structure.

Figure 5:
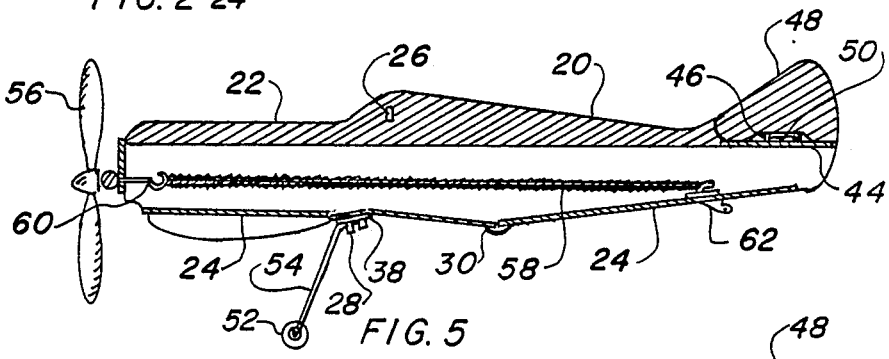
FIG. 5 is a cross-sectional view taken along lines 5—5 of FIG. 1 illustrating the twisted rubber band means of propulsion.
Figure 6:
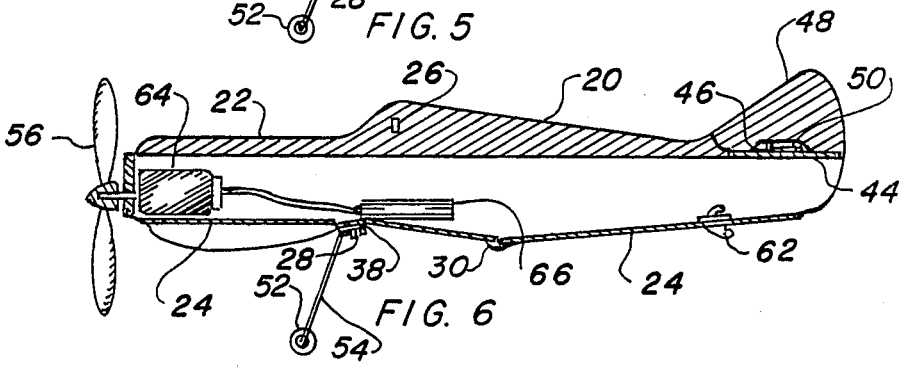
FIG. 6 is a cross-sectional view taken along lines 6—6 of FIG. 1 illustrating an electric motor and batteries for propulsion.

An aerodynamic shaped wing 34 is also die cut to the desired configuration and contains a pair of tendon supporting hooks 36 on the top surface each equally spaced from the normal longitudinal centerline of the model. The wing 34 also contains an attaching interlocking medial member 38 on the mid position of the wing at the above centerline. Both fasteners 36 and 38 are constructed in a similar manner, as above, using the same basic materials. FIG. 1 depicts the upper attachments, and FIG. 5 the interface connections. The wing 34 is positioned beneath the fuselage 20 with the wing attaching eye 28 on top penetrating the interlocking member 38 on the bottom, as shown in FIGS. 5 and 6, much like illustrated in FIG. 4, except inverted also the recess 30 gripping the trailing edge of the wing holding the wing in place on both the front and back portions. The shape of the wing is bent into an aerodynamic contour creating the necessary lift allowing the airplane to maintain flight.

A pair of wing supporting tendons 40, having a yoke 42 on each tip, are attached on one end to the tendon hook 26 on the fuselage 20 and to corresponding wing supporting tendons 40 on the other end through the yokes 42. These tendons 40 create a brace transmitting loads imposed on the wing 34 to the common tendon hook 26 on the fuselage 20 giving support and strength to the wing. The combination of the bend and the braces add sufficient stability to the wing to achieve the required structural integrity.

Figure 3:
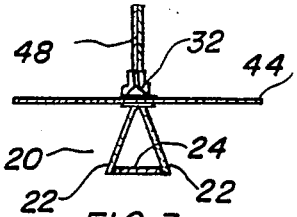
FIG. 3 is a cross-sectional view taken along lines 3—3 of FIG. 1 illustrating a cross-section of the fuselage.
Figure 4:
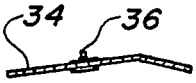
FIG. 4 is a cross-sectional view taken along lines 4—4 of FIG. 1 illustrating a cross-section of the wing.

The airplane further includes a tail consisting of an elevator 44 and a vertical stabilizer 48. The elevator contains a tail attaching plate 46 with openings that receive the inverted dovetail fastener 32 positioned on the bottom as illustrated in FIG. 3. The elevator 44 is placed on the trailing end of the fuselage 20 with the fastener 32 interfacing through the plate 46 and the vertical stabilizer 48 is then positioned at right angles to the elevator 44. The stabilizer 48 contains a projecting finger 50 that slides into the dovetail of the fastener 32 which is projected through the openings in the plate and now is positioned on top of the plate 46 uniting both elements mechanically to the fuselage 20. The tail, as an assembly, provides the horizontal and vertical stability for flight of the model.

The above components, with the exception of the fasteners and tendons, are fabricated of a foamed thermosetting material, such as expanded urethane foam, polystyrene beads, or the like, preferably having a more dense surface or skin on the outside. The fasteners and tendon yokes 42 may be made of any suitable thermoplastic material, such as polycarbonate, polyethylene, polypropylene, polyvinylchloride, and the like.

The landing gear consists of a pair of wheels 52 rotatably attached to an inverted "V" shaped wire strut 54. The apex of the strut 54 is bent angularly forming a clip-like end which is inserted into the wing attaching eye 28, best illustrated in FIG. 1, and wedgingly rests upon the interlocking medial member 38 forming a secure but removable attachment of the landing gear to the wing 34 and fuselage 20. The landing gear is sufficiently resilient to absorb shock loads imposed upon the model when the airplane is landing. Further, the wheels 52 rotate freely on the strut 54 providing mobility on a hard surface, such as the ground.

The force placed on the ambient air to propel the model is provided by an airscrew or propeller 56 rotatably attached to the front of the fuselage 20. The propeller 56 is actuated by means to rotate which sustains sufficient endurance to allow free flight of the model. In the preferred embodiment this means to rotate is provided by a twisted rubber band 58, which is 35 attached on one end to a propeller hook 60, integral with the propeller 56, and to a hooked rear fuselage skid 62 on the other. The skid 62 is positioned on the bottom of the fuselage 20 near the trailing end, therefore, allowing an extended span for the rubber band 58 almost the entire length of the model. The propeller 56 is rotated in one direction manually and is then released and unwinds, causing the air to be moved over the wings sustaining flight.

The second embodiment replaces the rubber band 58 and ancillary elements with an electric motor 64 powered by dry cell storage batteries 66. The propeller 56 is attached directly to the shaft of the motor 64, or may utilize a gear train for speed control and transmits torsional rotation through the electromotive force of the motor. The batteries 66 are positioned preferably within the fuselage 20 near the center of balance of the airplane and conduct the electrical power to the motor 64 through insulated wires.

The model is, by nature, having basically flat surfaces to start with, in its assembly process allows printing or silk screening to be applied to the surface outlining the details of the aircraft and the appropriate markings.

Assembly and dissembly of the model are easily accomplished using the procedures outlined and the fittings provided.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. A disassemblable flying model airplane comprising:

(a) a fuselage in the shape of an isoceles triangle, in cross-section taken transversely to the length of the fuselage, having equal angles at the bottom when said fuselage is oriented at a normal orientation, a projecting tendon hook on each side, a wing attaching eye on the bottom and tail attaching inverted dovetail fastener at the trailing end;

(b) an aerodynamic wing having a pair of tendon supporting hooks equally spaced on a top surface and an attaching interlocking medial member on the mid-position of the wing, the wing disposed beneath the fuselage interfacing through the medial member forming an interlocking union therebetween, the wing creating the necessary aerodynamic lift allowing the model airplane to fly;

(c) a pair of wing supporting tendons each having a yoke on each end, each tendon attached on one end to the projecting tendon hook and on the other end to the wing tendon supporting hook defining a brace transmitting loads imposed on the wing to the projecting tendon hooks on the fuselage giving support and stability to the wing;

(d) an elevator having a tail attaching plate with openings for receiving said attaching inverted dovetail juxtapositioned transversely onto said trailing end of the fusalage providing the vertical stability for the model airplane in flight;

(e) a vertical stabilizer having a projecting finger, connected to the top of the fuselage at the trailing end with the projecting finger interlocking into said tail attaching inverted dovetail and said elevator tail attaching plate therebetween creating an interrelated structural joint joining the trailing end, elevator and vertical stabilizer together in a disassemblable manner, said stabilizer providing the dynamic lateral stability required for flight;

(f) landing gear having wheels rotatably attached to an inverted "V" shaped wire strut with said apex of the strut inserted into said wing attaching eye with said wing interlocking medial member therebetween forming a removable attachment of said wing and landing gear to the fuselage, the landing gear sufficiently resilient to absorb loads imposed thereupon during landing of the model airplane and the wheels providing the rotation for mobility on the ground;

(g) a propeller rotatably abutting the front of said fuselage having an airscrew pulling the airplane forward through the air when revolved providing the dynamic motivation; and, (h) means to rotate the propeller contained within the fuselage creating the applied force to the propeller sustaining sufficient rotational endurance to allow free flight of the model airplane.

2. The flying model airplane as recited in claim 1 wherein said fuselage further comprises; said triangular shape having a height to width ratio from 1.12 to 1.50:1.0 and said fuselage having a separate pair of identical, except opposed, sides and an independent bottom bonded together forming a truss-like structure with sufficient structural integrity to maintain, during flight, the shape and form of the aircraft upon which the model is based.

3. The flying model airplane as recited in claim 1 wherein said means to rotate the propeller further comprise; a twisted rubber- band, a propeller hook and a hooked rear fuselage skid, with the rubber band connected on one end to the hook, which is fixably fastened to said propeller and on the other end to the fuselage skid, which is in turn, fastened directly to the underside of the fuselage allowing the propeller to be manually wound in a rotary fashion and then released thereby freely rotating, propelling the airplane in the air.

4. The flying model airplane as recited in claim 1 wherein said means to rotate the propeller further comprise; an electric motor with an electric power source, the motor is attached to said propeller creating a torsional rotation through the electromotive force of the motor.

5. The flying model airplane as recited in claim 4 wherein said electric power source further comprises; a plurality of dry cell storage batteries positioned within said fuselage near a center of balance of the airplane and connected to the motor with electrically conductive wires.

6. The flying model airplane as recited in claim 1 wherein said fuselage, wing, elevator, and vertical stabilizer are all made of a foamed thermoset material.

* * * * *